United States Patent [19]

Röhm

[11] Patent Number: 4,627,185

[45] Date of Patent: Dec. 9, 1986

[54] SAFETY HAMMER LOCK FOR A HAND WEAPON

[76] Inventor: Günter H. Röhm,
Heinrich-Röhm-Str. 50, 7927
Sontheim, Fed. Rep. of Germany

[21] Appl. No.: 692,907

[22] Filed: Jan. 18, 1985

[30] Foreign Application Priority Data

Jan. 21, 1984 [DE] Fed. Rep. of Germany ..... 3402007

[51] Int. Cl.[4] ..... F41C 17/04

[52] U.S. Cl. ..... 42/66; 42/70.08

[58] Field of Search ..... 42/66, 70 F

[56] References Cited

U.S. PATENT DOCUMENTS

| | | | |
|---|---|---|---|
| 2,863,249 | 12/1958 | Kouck et al. | 42/66 |
| 3,768,190 | 10/1973 | Ruger et al. | 42/66 |
| 3,824,728 | 7/1974 | Kennedy | 42/66 |
| 4,316,341 | 2/1982 | Landry | 42/66 |

FOREIGN PATENT DOCUMENTS

| | | | |
|---|---|---|---|
| 1045857 | 8/1956 | Fed. Rep. of Germany . | |
| 1147871 | 4/1963 | Fed. Rep. of Germany | 42/66 |

*Primary Examiner*—Deborah L. Kyle
*Assistant Examiner*—Michael J. Carone
*Attorney, Agent, or Firm*—Karl F. Ross; Herbert Dubno

[57] ABSTRACT

A safety mechanism for a revolver having a breech lock arranged at the drum on a breech lock shaft and able rotate to enable loading of the respective cartridge chamber. When the breech lock is swung out, a detent latch is disengaged from the drum catch by way of the breech lock shaft and a check part. A lock unit cooperates with the breech lock shaft, and this lock unit includes a movably guided lock member, a pin in one embodiment, which extends generally parallel with respect to the axis of rotation of the cock and which is controllable and adjustable by the breech lock shaft when the breech lock shaft is swung out in the direction towards the cock. The cock includes a lateral surface which extend substantially perpendicularly with respect to the axis about which the cock can pivot, and which forms a stop for the lock unit. In this surface there is also included a retaining recess into which the lock member can enter when the cock is in its rest position when the breech lock is swung out.

16 Claims, 7 Drawing Figures

SAFETY HAMMER LOCK FOR A HAND WEAPON

FIELD OF THE INVENTION

My present invention relates to a safety mechanism or system for a hand weapon and more particularly, to a safety mechanism for a cylinder fed weapon such as a revolver or the like.

BACKGROUND OF THE INVENTION

A cylinder-fed weapon includes a weapon frame and a barrel. A cock is pivotally mounted on its shaft in the frame to swing about an axis perpendicular to the barrel axis and a trigger is also pivotally mounted on its shaft in the frame. The two shafts or the axes of rotations of the trigger and cock extend parallel to each other.

The cock can be pivoted or swung from its rest position, against the force of a cock spring, into a "cocked" position in which it is held under preload by a thereby stressed cock spring. The trigger can be rotated from its rest position, against the force of a trigger spring, into a position corresponding to firing-readiness condition of the weapon.

The weapon also includes a cylinder with several angularly equispaced cartridge chambers. This cylinder is mounted in the frame so that it can rotate about a cylinder-shaft axis which is parallel to the barrel axis.

A detent latch holds the cylinder in each firing position with a respective chamber aligned with the barrel. The detent latch engages drum recesses or catches formed along the periphery of the cylinder and the cylinder, accordingly, is capable of being stepped or indexed, i.e. advanced to bring succeeding cartridge chambers in line with the barrel.

The weapon also includes a chamber cover or loading flap swingably mounted on the frame by a shaft at the cylinder side which is turned away from the barrel. The flap shaft extends parallel to the drum shaft. The loading flap can be swung into a position, also referred to as a swung-out or open position hereinafter, in which the loading flap permits loading—in axial direction—of at least one thereby uncovered cartridge chamber of the cylinder. Conversely, the breech lock can also assume an in-swung or closed position in which loading will be precluded.

When the loading flap is in its swung-out position, the detent latch is disengaged from the drum catch. When the loading flap is in the swung-out position, the swinging or pivoting of the cock into the cocking position is prevented. Conversely when the cock is moved to the cocked position, the swing-out of the loading flap.

U.S. Pat. No. 3,768,190 describes a safety mechanism for a revolver with a cartridge cylinder. The lock unit in the prior art revolver is formed by a locking cam formation. The one end of the cam formation is arranged at a lever component of the trigger, which lever component extends towards the breech lock. The cam formation extends into corresponding openings in the shaft of the loading flap. The openings in the loading flap shaft are arranged in such a way that—when the loading flap is closed—the locking formation is displaceable and adjustable approximately in axial direction along the loading flap shaft, and thereby, the trigger can be brought into the ready-to-fire condition.

In contrast, when the locking flap is swung-out, the locking formation during pulling of the trigger abuts a stop surface arranged at the locking flap shaft. When the trigger is pulled to the firing-readiness position, the locking formation extends flat against a planar surface in a predetermined facing position with respect to a correspondingly planar surface or formation at the locking flap shaft. Accordingly, rotation of the latter and swinging-out of the breech lock are precluded. It can thus be ensured that the weapon can not be cocked during loading and unloading.

It is of disadvantage in this prior art safety mechanism that the lock unit is operative between the breech lock shaft and the trigger, while the weapon is cocked by swinging of the cock. Accordingly, the lock unit only indirectly acts upon the cock.

OBJECTS OF THE INVENTION

It is therefore the principal object of the invention to provide an improved revolver which substantially precludes the disadvantages of the prior art.

It is also an object of the present invention to provide an improved safety mechanism which is used for the purposes described and which ensures that the cock movement is directly limited when the loading flap is swung out.

It is further an object of the invention to provide an improved revolver which has a minimal number of moving parts but yet has improved safety and reliability.

It is also an object of the invention to provide a revolver which has enhanced safety features.

SUMMARY OF THE INVENTION

These objects are attained in accordance with the invention in that the lock unit is provided by a lock part or pin which is movably guided in the frame and generally extends parallel to the axis of rotation of the cock in the weapon frame, and which is shiftable towards and always from the cock by a cylinder flap shaft when the flap is swung out.

In addition, the cock or hammer has two lateral surfaces or flanks which extend substantially parallel to each other and perpendicularly with respect to the axis of rotation of the hammer or cock. One of these lateral surfaces form a stop for the lock pin. Furthermore, this lateral surface or side includes a retaining recess into which the lock pin enters when the cock is in its rest position when the flap is swung out.

Thus the cock is directly locked against cocking by the lock pin. Furthermore, the force of cocking on the cock is transferred to the frame via the lock pin to enhance the safety function considerably.

Advantageously, the lock pin has, for its displacement, a displacement recess which is directed toward or faces the locking flap shaft. The flap shaft, in turn, has an adjustment finger which engages in this recess of the pin. The adjustment finger, while extending axially, is positioned eccentrically with respect to the flap shaft axis.

The lock pin, accordingly, is shifted directly and in both directions of movement by the shifting finger, and additional springs and the like acting on the lock pin are not required.

When viewed in cross section, the adjustment finger is preferably of a configuration of slightly less than a quarter-sector of a circle, with the respective central angle of the sector being less than 90°.

In accordance with another preferred embodiment, the lock pin is a circularly cylindrical lock pin which—for its securement or retention against rotating or turning in a bore in the weapon frame—includes a guide groove which is formed axially in the cylindrical surface of the pin. A complementary projection, shoulder, ledge or rib engages in the groove and extends into the bore for the lock pin in the frame.

In accordance with another preferred feature, the adjustment recess in the lock member or lock pin is formed by a groove which extends perpendicularly to the shifting direction of the lock pin. The adjustment recess or groove has lateral surfaces which form the stops for the adjustment finger on the flap shaft.

In accordance with another preferred feature, the flap shaft has a recess which is axially adjacent to the adjustment finger. Furthermore, a check part pawl is positioned beneath the lock member and the flap shaft. Preferably, the pawl is in the form of a pivotally or tiltable actuator latch in the form of a two-arm lever with the shorter arm thereof, with its free end, under the force of a helical spring and adapted to engage in the recess of the flap shaft. The longer arm of the two-arm lever end-wise engages a pin of the detent latch.

The difference in length of the arms contributes to the advantage that relatively small adjustment distances will be sufficient for the cam formation or recess of the flap shaft to enable disengagement of the detent latch from the drum catch. The drum is then free to rotate when the flap is in the open condition.

BRIEF DESCRIPTION OF THE DRAWING

The above and other objects, features and advantages will become apparent from the following description, reference being made to the accompanying drawing, in which.

SPECIFIC DESCRIPTION

Figure 1:
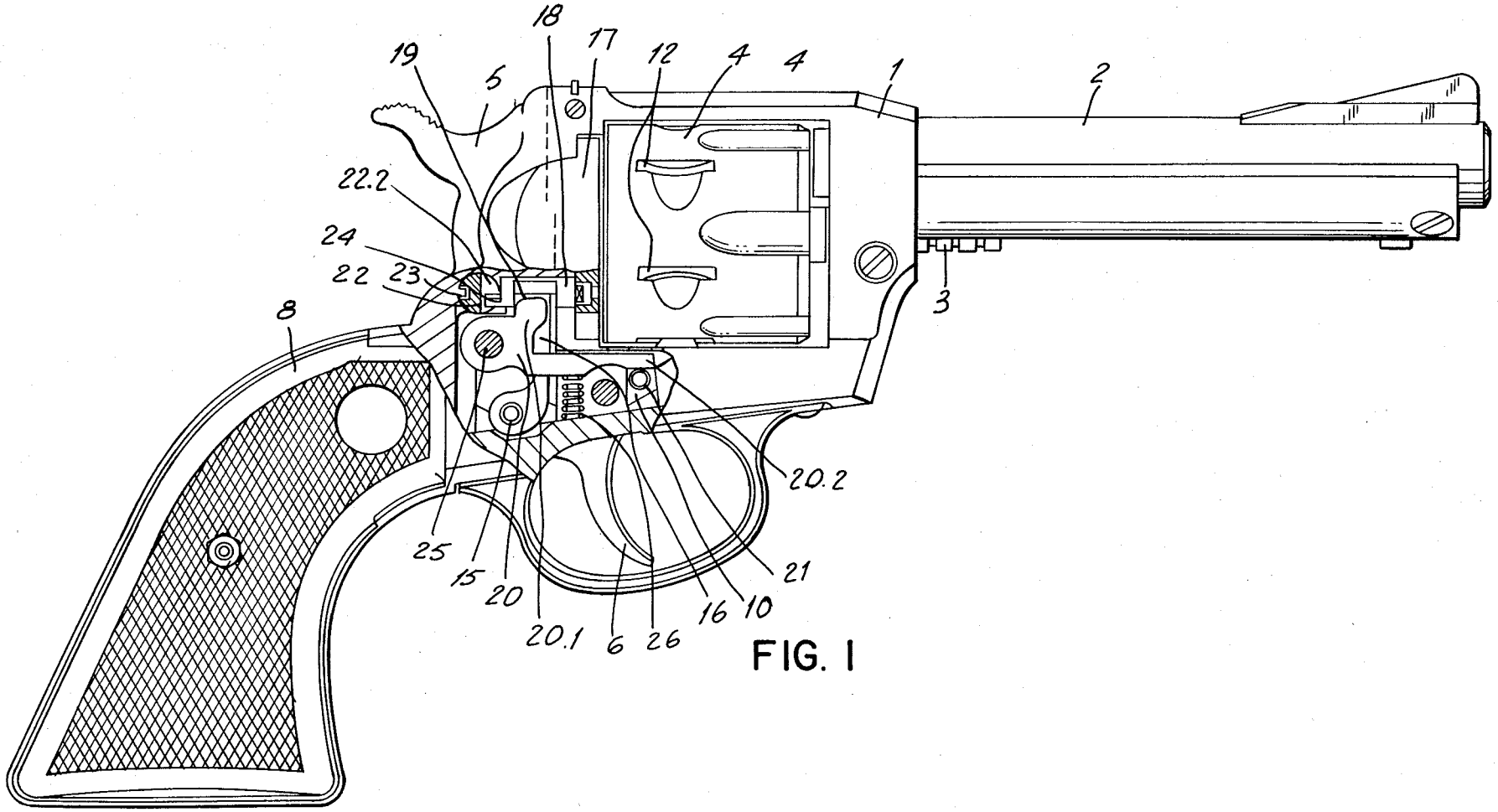
FIG. 1 is a side elevation of a revolver with a safety system in accordance with the invention, partly in section along line I—I of FIG. 3.
Figure 2:
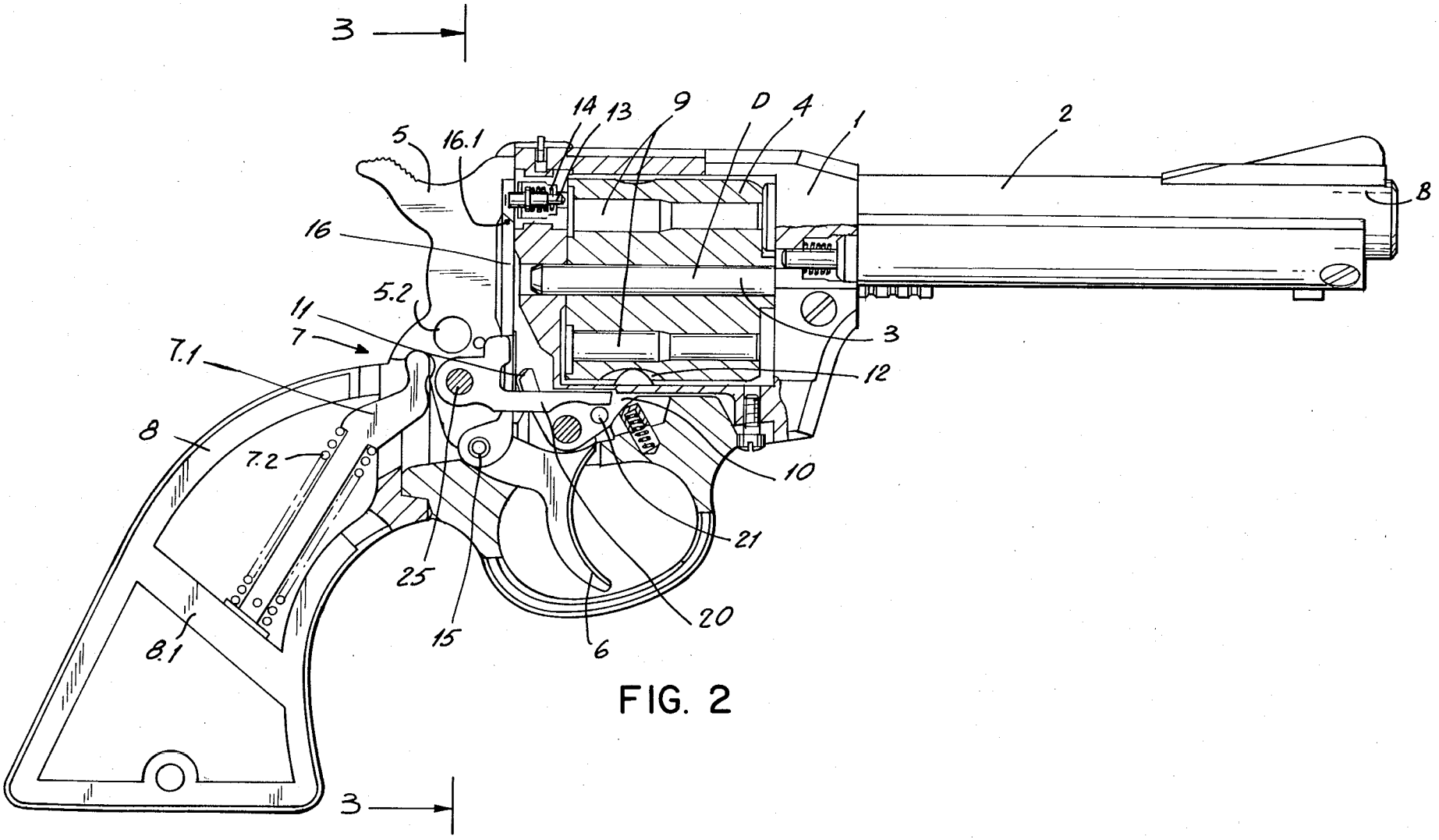
FIG. 2 is a view similar to FIG. 1 showing different parts broken away approximately at the central transverse plane of the revolver.

The safety mechanism shown in the drawing is particularly intended for single-shot or single firing weapons, for example revolvers, handguns, and the like small hand held weapons. FIGS. 1 and 2 show a revolver, i.e. a handgun with a cylinder of several chambers brought successively into line with the barrel and discharged in succession by the hammer.

With reference to FIG. 2, the revolver basically includes a weapon frame 1, or frame, with the associated barrel 2 connected thereto. The revolver also includes a cylinder or drum 4 which is mounted at the frame 1 so that it can rotate or revolve about the shaft or axle 3, and the central and longitudinal axis D of the axle serves as the axis of rotation for the drum 4.

In the frame 1 a hammer or cock 5 is also mounted which is secured on its axle or shaft 5.2. The cock includes lateral surfaces 5.1 and 5.3 (FIGS. 3 and 4) which will be described in greater detail below. Furthermore, a trigger 6 is secured on its axle or shaft 15 in the frame 1. The cock 5 and the trigger 6 can be pivoted, swung, or rotated about the respective axes of rotation provided by the shafts 5.2 and 15.

The revolver also includes a cocking mechanism 7 for the cock 5. This mechanism 7 includes a fulcrum arm or end 7.1 in the handle or grip 8, and a spring 7.2 for stressing or loading the mechanism 7 is disposed with its helical coils about the fulcrum end 7.1 in the handle or grip 8. The fulcrum end 7.1 is secured with its lower end to a strut 8.1 of the grip 8 which is connected to the frame 1.

The drum 4 has several cartridge chambers 9 which can be successively brought into line with the bore B of the barrel 2 by rotating or revolving the drum 4 about its axis of rotation D. Transport or rotation of the drum 4 is affected by a conventional transport pawl engaging teeth on the rear of the cylinder and not shown.

To allow advancing, transporting, or rotation of the drum 4, the detent latch 10 temporarily releases a respective drum catch 12 (FIG. 1), and the drum 4 can turn during the release. The detent latch 10 is moved by an actuating pin of the cock 5 which engages a surface or formation 11 of the detent latch 10.

Furthermore, a firing pin or striker 13 is arranged for axial and longitudinal movement in the frame 1. When the revolver is fired, the striker 13 is axially driven by the hammer or cock against the action of the compression spring 14, to strike a cartridge loaded in the uppermost cartridge chamber 9 of the drum 4. To effect firing or discharge of the weapon, the trigger bar 16 is linked to a pivot or pivot shaft at 15 to the trigger 6. The trigger bar 16 extends generally between the frame 1 and the cock 5. In response to movements of the trigger 6, the trigger bar 16 is moved in the vertical longitudinal direction. The trigger bar 16 includes an inclined surface or formation 16.1 which can be brought between the striker 13 and the cock 5 when the trigger 6 is moved while the revolver is in ready-to-fire condition.

On pulling the trigger 6 for firing, the rebounding cock 5, via the trigger bar 16 drives the striker pin 13 in the direction of the cartridge chamber 9.

With reference to FIG. 1, a breech lock or cylinder-covering flap 17 is connected to the frame 1 on that side of cylinder 4 which is facing away from the barrel 2. The breech lock 17 is mounted on its own shaft or axle 18, and the longitudinal and central axis L of this is the axis of rotation of the flap 17 when viewed in side elevation, for example FIG. 7. The shaft 18 is arranged to be parallel with respect to shaft 13 (FIG. 2) of the chamber 4, and the breech lock 17 can pivot or swing about the axis of rotation L.

Figure 4:
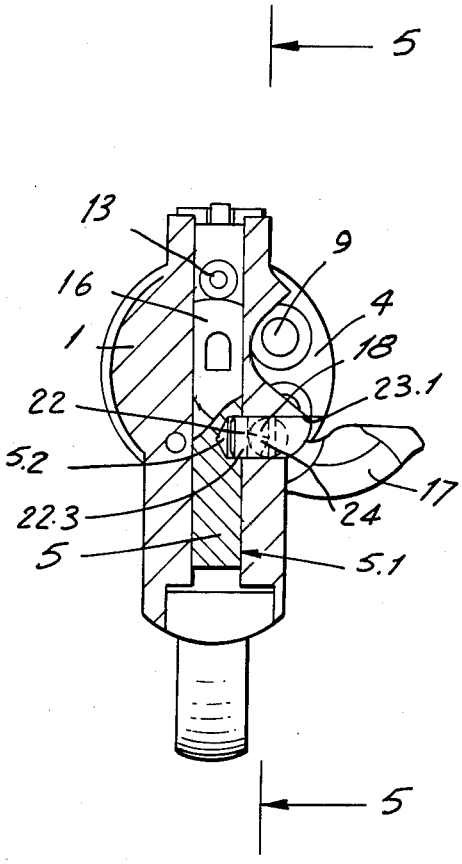
FIG. 4 is a cross section similar to FIG. 3 but with the breech lock shown in the open position.

When the flap 17 is swung out as is indicated in FIG. 4, it uncovers at least one cartridge chamber 9 for the loading of a cartridge, or for the ejection of a cartridge case, respectively.

Figure 7:
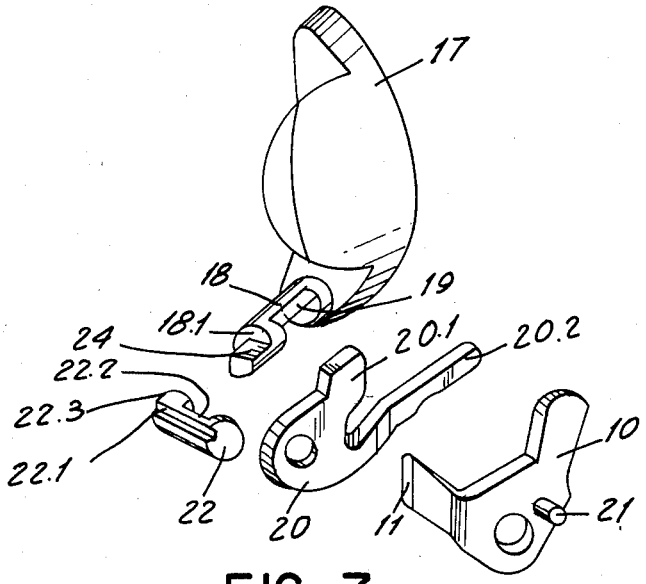
FIG. 7 is an exploded view showing in greater details the breech lock, the lock member, the detent latch and the check part.
Figure 6:
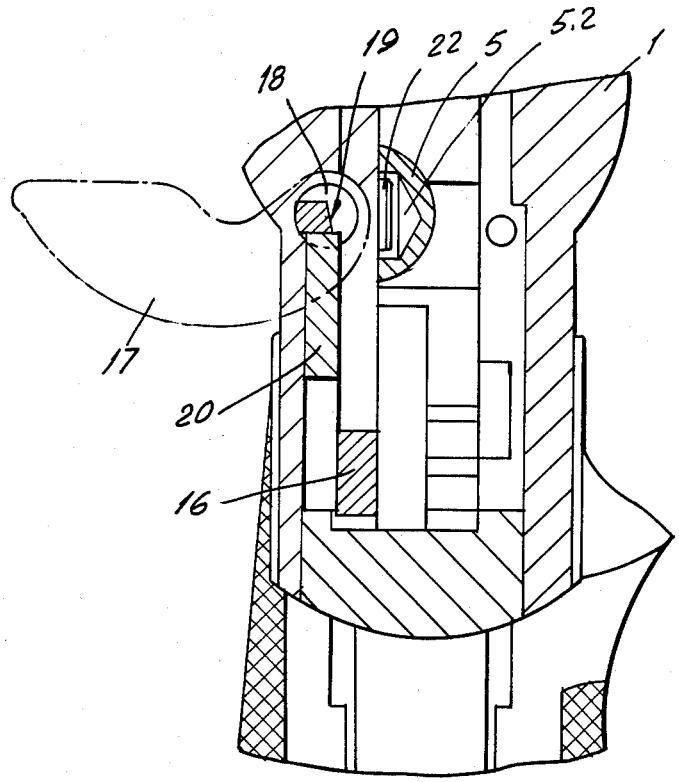
FIG. 6 is a cross section drawn in the scale of FIG. 5 and taken along line VI—VI of FIG. 5.

The shaft 18 rotates with the breech lock, i.e. is fixed to the breech lock and does not rotate with respect thereto. The shaft 18 is journaled in the frame and has a cam formation or recess 19 (FIG. 6) which cooperates with a check part 20 (FIG. 7). When the breech lock 17 is swung out, by way of a projecting check pin 21, the check part 20 can disengage the detent latch 10 from the respective drum catch 12. Furthermore, the shaft 18 of the breech lock 17 actuates a lock member or lock pin 22 which extends generally parallel with respect to the axis of rotation of the cock 5. The lock pin 22 is also axially movably guided in the frame 1.

Figure 3:
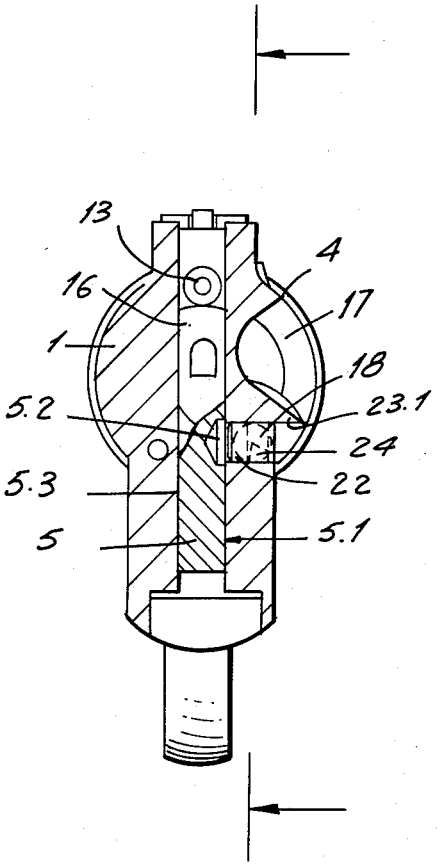
FIG. 3 is a cross section along line III—III of FIG. 2 showing the breech lock or locking flap in the closed position.

As is indicated in FIG. 3, when the breech lock 17 is in the closed position, the lock pin 22 extends at a small distance away, in the opposing sense, from the surface or side 5.1 of the hammer 5, which side is disposed perpendicularly with respect to the axis of rotation 22.6 of the lock part 22. When the breech lock 17 is swung out, as is represented in FIG. 4, the lock pin 22 moves with its respective larger end 22.3 into the bore or lock bore 5.2 of the cock 5 and precludes movement of the cock 5 to assume the cocked position. However, when the hammer 5 is only minutely swung from its rest position, then the lock pin 22 engages the flank 5.1 of the cock 5 and, accordingly, precludes swinging out of the breech lock 17 due to the effective length of the recess 22.2. The side 5.1 extends parallel to the other side or surface 5.3 of the hammer or cock 5.

The lock pin 22 is generally of cylindrical configuration, i.e. it is round or circular when viewed in cross section and, accordingly, it can also be referred to as lock pin 22 in the following.

The lock pin 22 is secured against rotation in bore 23.1 (FIGS. 3 and 4) in the frame 1. For this purpose, the lock pin 22 has a longitudinal groove 22.1 which extends in the longitudinal and axial direction in the outer circumference or mantle of the lock pin 22. This groove 22.1 is filled by a rib or bar 23 (FIG. 5) which extends in the bore 23.1 in a complementary manner with respect to groove 22.1. The lock pin also includes an adjustment groove or recess 22.2 which faces toward the breech lock shaft or axle 18 (FIG. 7).

An adjustment finger 24 is provided at the frontal or forward surface, i.e. the surface 18.1 directed away from the barrel 2, of the breech lock shaft 18 and this finger 24 is positioned eccentrically, when viewed in cross section, with respect to the longitudinal and central axis L of the shaft 18.

The adjustment finger 24 has a cross-sectional configuration which is at least in part equivalent to the less than one-quarter of a circle, or less than one-quarter sector of a circle, i.e. the respective angle of the sector has its apex offset from the respective center point of the shaft 18, when viewed in cross section, and the angle is less than 90°.

The adjustment recess 22.2 at the lock pin 22 is formed by a groove which extends generally perpendicularly with respect to the shifting direction (axial direction) (FIG. 5) of the lock pin 22, and the side walls 22.4 and 22.5 of the groove 22.2 provide stops for the adjustment finger 24.

A cam formation or recess 19 is arranged on the shaft 18 and axially adjacent to the adjustment finger 24.

The check part 20 is mounted on shaft 25. The longitudinal axis 25.1 of the shaft 25 is the axis of rotation for the check part 20. The check part 20 performs the function of a control latch or lever and has two arms, a shorter arm 20.1 and a longer arm 20.2. The check part 20 is generally located beneath the lock pin 22 (FIG. 1) with its shorter arm 20.1. The longer arm 20.2 is generally disposed beneath the shaft 18.

Specifically, the shorter arm 20.1 engages with its upper free end, under the force of a helical spring 26, in the cam formation or recess 19 of the shaft 18. The longer arm 20.2 in turn, at its free end cooperates with the check pin 21 of the detent latch 10. In this way, the detent latch 10, even when the adjustment distance of the recess 19 is small, is fully disengaged from the drum catch 12, and the drum 4 can be freely rotated for loading or unloading, respectively.

Figure 5:
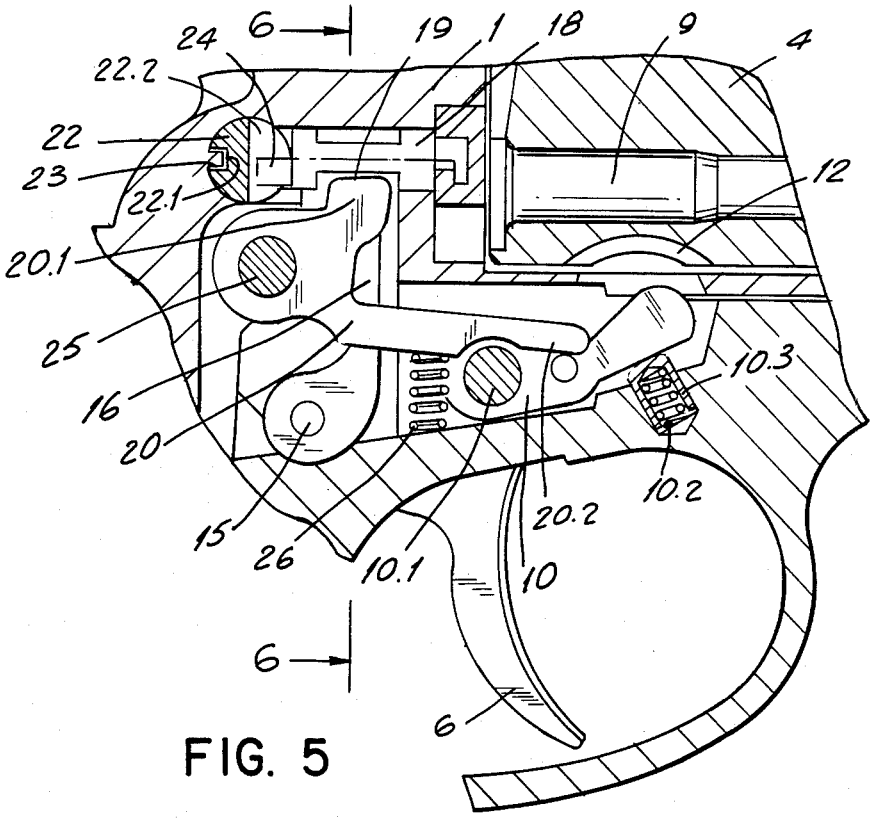
FIG. 5 is a cross section along line V—V of FIG. 4 drawn to a larger scale.

The detent latch 10 is mounted on its shaft 10.1 and tensioned by spring 10.2 which is disposed in a control pin 10.3 and a respective bore in frame 1 (FIG. 5).

The longer arm 20.2 is furnished with a cam surface 20.21 which cooperates with the shaft 10.1.

I claim:

1. A revolver comprising:

a weapon frame including a grip for holding said weapon;

a barrel mounted at said frame;

a trigger mounted in said frame on a respective trigger shaft near said handle and in association with a respective trigger spring, said trigger being adapted to be pivoted about the respective axis of rotation of said trigger shaft at least against the force of said trigger spring from its rest position into a position corresponding to a ready-to-fire condition of said weapon;

a hammer mounted in said frame on a respective hammer shaft near said handle and in association with a respective hammer spring, said hammer being adapted to be pivoted and swung about an axis of rotation of said hammer shaft at least against the force of said hammer spring, from its rest position into a position in which it is held under tension of said hammer spring, said hammer shaft extending substantially parallel with respect to said trigger shaft;

a drum including a plurality of cartridge chambers interiorly disposed in said drum and a plurality of drum catches exteriorly disposed on said drum, said drum being mounted in said weapon frame between said barrel and said grip on a respective drum shaft, said drum shaft extending substantially parallel with respect to said barrel;

a detent latch adapted to engage and disengage at least one of said plurality of drum catches, whereby rotation of said drum with respect to an axis of rotation of said drum shaft is precluded when said detent latch engages a respective drum catch and rotation of said drum is allowed when said detent latch is disengaged from the respective drum catch;

a breech lock mounted in said frame on a side of said drum toward said grip so as to be able to be moved from a first position, in which at least one of said plurality of cartridge chambers is available for loading a cartridge in axial direction into a respective available cartridge chamber, into a position substantially precluding access to a cartridge chamber;

a breech lock shaft secured to said breech lock so as to be moved therewith, said breech lock shaft having at least one recess;

a check part mounted in said frame on a respective shaft near said grip and in association with a respective check spring, said check part including a check pin, whereby said check part is adapted at least when said breech lock is in its swung out position to disengage said detent latch from a pertaining drum catch; and a lock unit, said lock unit being at least capable of precluding—when said breech lock is swung out—movement of said hammer to assume the tensioned position and swinging out of said breech lock—when said hammer is tensioned;

said lock unit being provided by a movably guided lock member which extends and moves transversely along an axis generally parallel with respect to the axis of rotation of said hammer in said weapon frame, and being adjustable in the direction towards said hammer by said breech lock shaft during swinging-out of said breech lock;

said hammer having at least two lateral surfaces extending parallel with respect to each other and perpendicularly with respect to the axis of rotation of said hammer, whereby one lateral surface provides a stop for said lock member; and said hammer also including a retaining recess in the stop providing surface, whereby said lock member is adapted to enter said retaining recess—when said hammer is in its rest position and said breech lock is swung out.

2. The weapon according to claim 1 wherein said breech lock shaft also includes an adjustment finger which is disposed forwardly in the direction of said grip, said adjustment finger being positioned substantially eccentrically with respect to the breech lock shaft; and wherein said lock member includes—for its adjustment—an adjustment recess, said recess being directed towards said breech lock shaft and being adapted to be engaged by said adjustment finger for respective adjustment movements.

3. The weapon according to claim 2 wherein said adjustment finger when viewed in cross section is of circle-sector configuration, with the centri-angle of the circle-sector being slightly less than 90°.

4. The weapon according to claim 2 wherein said lock member is a cylindrical lock pin with an axially directed guide groove in its respective outer surface; and wherein said weapon frame includes a bore adapted to receive and retain said cylindrical lock pin by means of a shoulder.

5. The weapon according to claim 2 wherein said at least one adjustment recess in said lock member is formed by a groove, said groove substantially extending vertically with respect to the direction of shifting of said lock member, and having an lateral and opposing surfaces, said an lateral surfaces forming stops for said adjustment finger.

6. The weapon according to claim 2 wherein said breech lock shaft includes a recess, said recess being axially adjacent to said adjustment finger; and wherein said check part extends substantially beneath said lock member and said breech lock shaft; said check part including a swingable actuator latch in the form of a two-armed lever, with the respective shorter arm of said two-armed lever with its free end being under the force of said check spring; and with the respective longer arm of said two-armed lever cooperating in endwise manner with said check pin of said check part.

7. The weapon according to claim 6 wherein said longer arm includes at least one cam surface adapted to cooperate with said check pin of said check part.

8. The weapon according to claim 6 wherein said check spring is mounted in said frame for urging the respective end of said detent latch into engagement with a respective drum catch.

9. In a revolver having a revolver frame formed with a grip and a barrel, a trigger swingable about an axis perpendicular to an axis of the barrel, a cock swingable about an axis parallel to the trigger axis, a cylinder having a plurality of cartridge chambers rotatable on said frame about an axis parallel to said barrel, and a cylinder cover flap swingable adjacent an end of said cylinder turned away from said barrel between a closed position wherein said chambers are inaccessible and an open position wherein at least one of said chambers is accessible for loading, the improvement which comprises a safety mechanism, said safety mechanism comprising:

a locking member shiftable transversely to said cock and confronting a flank thereof forming a stop for said member, said flank being formed with a recess receiving said member for immobilizing said cocks; and a shaft connected to said flap and rotatable in said frame with said flap, said shaft being operatively connected to said member whereby said flap is prevented from pivoting into said open position unless said recess registers with said member and swinging of said flap into said open position immobilizes said cock, said locking member being formed with a groove defined between two surfaces and said shaft has an axially extending finger projecting into said groove and engageable with said surfaces to shift said member.

10. The improvement defined in claim 9 wherein said shaft has a cavity, said mechanism further comprising a double-arm lever pivoted on said frame and having a short arm engaging in said cavity and a long arm, said revolver having a detent engageable in catches formed on said cylinder, said long arm being positioned to engage said detent and release said cylinder when said flap is swung into said open position.

11. The improvement defined in claim 9 wherein said shaft has a cavity, said mechanism further comprising a double-arm lever pivoted on said frame and having a short arm engaging in said cavity and a long arm, said revolver having a detent engageable in catches formed on said cylinder, said long arm being positioned to engage said detent and release said cylinder when said flap is swung into said open position.

12. The improvement defined in claim 9 wherein said finger has a configuration in section of a cylindrical sector with a central angle of less than 90°.

13. The improvement defined in claim 12 wherein said shaft has a cavity, said mechanism further comprising a double-arm lever pivoted on said frame and having a short arm engaging in said cavity and a long arm, said revolver having a detent engageable in catches formed on said cylinder, said long arm being positioned to engage said detent and release said cylinder when said flap is swung into said open position.

14. The improvement defined in claim 12 wherein said member is a circularly cylindrical pin provided with means preventing rotation thereof on said frame but shiftable axially thereon by said finger.

15. The improvement defined in claim 14 wherein said shaft has a cavity, said mechanism further comprising a double-arm lever pivoted on said frame and having a short arm engaging in said cavity and a long arm, said revolver having a detent engageable in catches formed on said cylinder, said long arm being positioned to engage said detent and release said cylinder when said flap is swung into said open position.

16. The improvement defined in claim 15 wherein said shaft has a cavity, said mechanism further comprising a double-arm lever pivoted on said frame and having a short arm engaging in said cavity and a long arm, said revolver having a detent engageable in catches formed on said cylinder, said long arm being positioned to engage said detent and release said cylinder when said flap is swung into said open position.

* * * * *